US007798826B2

(12) United States Patent
Leyden

(10) Patent No.: US 7,798,826 B2
(45) Date of Patent: Sep. 21, 2010

(54) SECURITY SYSTEM FOR ELECTRONIC DEVICE

(75) Inventor: Roger Leyden, Inverness, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 1171 days.

(21) Appl. No.: 11/429,086

(22) Filed: May 5, 2006

(65) Prior Publication Data

US 2007/0294764 A1 Dec. 20, 2007

(51) Int. Cl.
*E05B 73/00* (2006.01)

(52) U.S. Cl. ..... 439/133; 70/58; 70/DIG. 57

(58) Field of Classification Search ..... 439/133, 439/134; 70/57, 58, DIG. 57
See application file for complete search history.

(56) References Cited

U.S. PATENT DOCUMENTS 4,669,281 A * 6/1987 Young ..... 70/57
5,172,098 A 12/1992 Leyden et al.
5,794,463 A * 8/1998 McDaid ..... 70/18
6,196,857 B1 * 3/2001 Fong ..... 439/304
6,212,922 B1 * 4/2001 Miao ..... 70/58
6,560,710 B1 5/2003 Leyden et al.
6,796,152 B1 * 9/2004 Yu ..... 70/58
6,848,926 B2 * 2/2005 Ling et al. ..... 439/304

* cited by examiner

*Primary Examiner*—Neil Abrams
(74) *Attorney, Agent, or Firm*—Wood, Phillips, Katz, Clark & Mortimer

(57) ABSTRACT

The combination of an electronic device and a security system for monitoring the electronic device with the security system in an operative state with respect to the electronic device. The electronic device has a port with a connector assembly through which an electrical path to the electronic device can be established and at least a first threaded opening. The security system has a housing and at least a first fastener that can be directed into the at least first threaded opening and changed from a pre-assembly position into a secured position to thereby maintain the housing in an operative position on the electronic device. At least one component is directed into the housing to block access to the at least first fastener as might allow changing of the at least first fastener from the secured position into the pre-assembly position. The housing is securable relative to a support to confine movement of the electronic device relative to the support.

25 Claims, 6 Drawing Sheets

FIG. 9
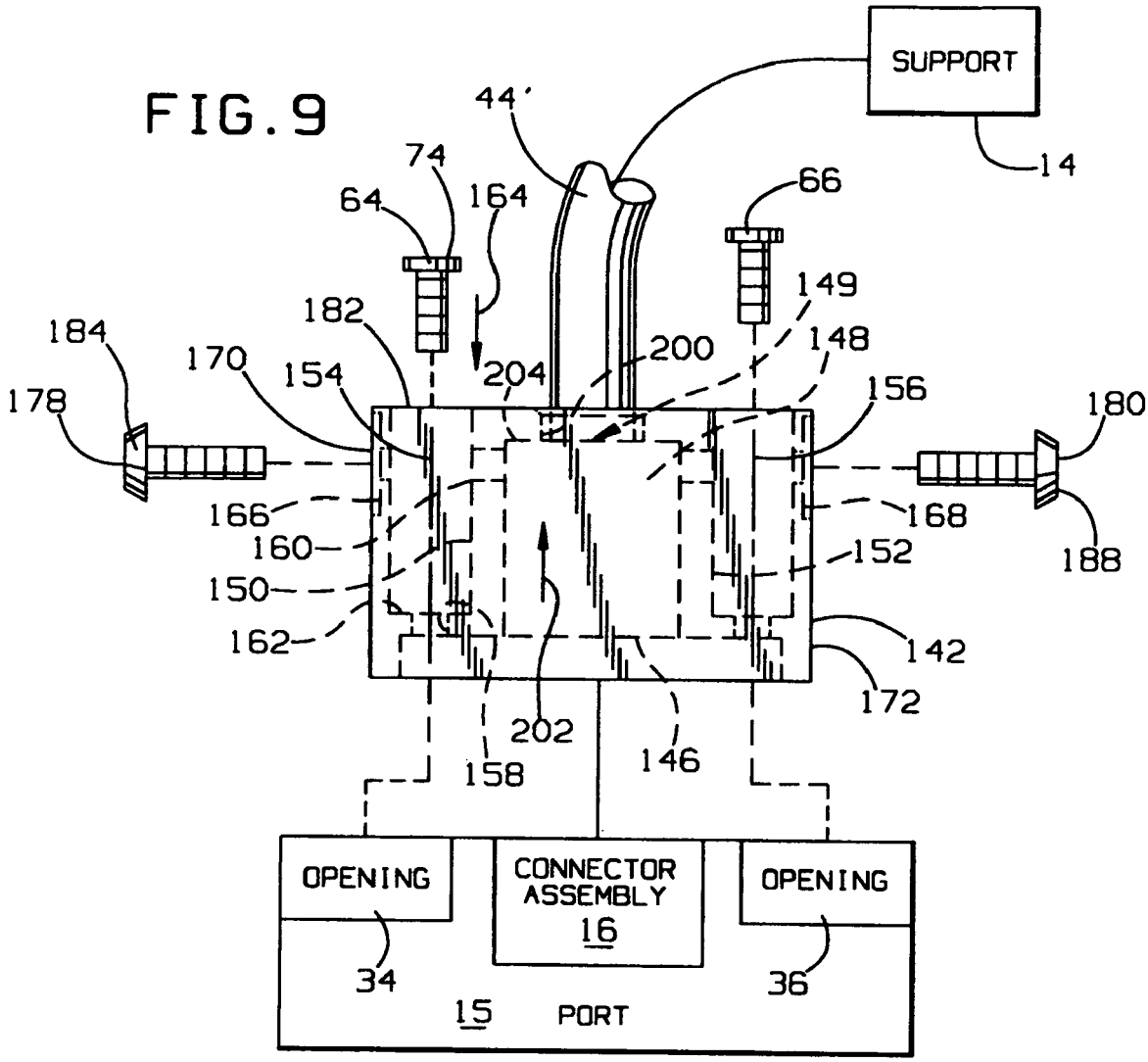
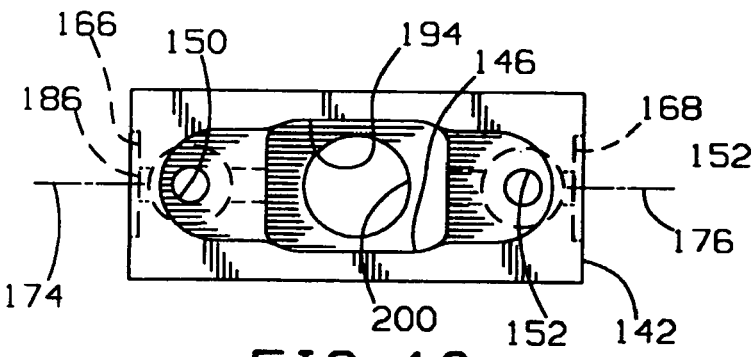
FIG. 10
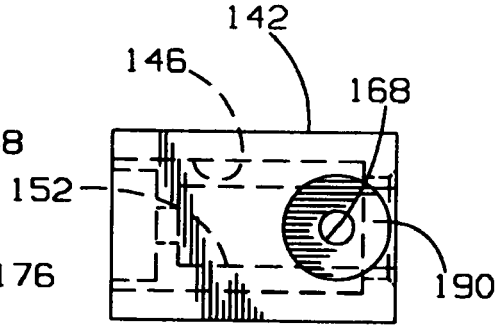
FIG. 11

SECURITY SYSTEM FOR ELECTRONIC DEVICE

BACKGROUND OF THE INVENTION

1. Field of the Invention

This invention relates to security systems and, more particularly, to a security system for an electronic device having an accessible connecting port.

2. Background Art

With the proliferation of electronic devices comes the challenge of preventing theft thereof from homes and businesses in which the electronic devices are utilized and in businesses in which they are displayed for sale.

The objectives of those designing security systems for electronic devices are generally threefold. First of all, the security systems must be effective in terms of protecting the devices with which they are used. Second, the systems must be configured so that they can be conveniently installed and maintained by those that purchase them. Third, the systems must be in a price range that the investment therein is justified based upon the anticipated losses in the absence of the use of such systems.

A number of different systems currently exist to secure electronic devices and other portable articles. As one example, electronic systems, as disclosed in U.S. Pat. No. 5,172,098, have been used for years to monitor, and prevent theft of, electronic devices, particularly at point-of-purchase displays. These systems typically have a sensor that is armed as an incident of being adhered to a surface of a portable device. If the system is compromised by a would-be thief, either by removing the sensor or severing a conductive cord associated with the sensor, a detectible signal is generated to alert those in charge of monitoring the devices that there has been a breach.

This type of system is generally used on relatively small portable electronic devices and has been highly commercially successful. Generally, this type of system employs a conductive cord that is highly flexible and prone to being severed. Thus, the cord itself does not offer any significant mechanical impediment to theft. These systems are also more expensive than their purely mechanical counterparts.

One known mechanical system utilizes a restrictable lasso. The lasso can be extended around the periphery of a particular object or directed through a fully surrounded opening defined thereby. A number of electronic devices do not lend themselves to being secured by such purely mechanical systems. This has led to the evolution of other devices, such as that shown on U.S. Pat. No. 6,560,710, which is designed to capture the housing of a computer and is peculiar to its shape.

Another known mechanical security system is designed to connect to the electronic device at a plug-in port thereon. This commonly is done at serial and parallel ports on computers and peripherals. These ports use complementary "D"-shaped connecting parts that interact to perform a shielding function and also consistently align the parts for interconnection. Generally two threaded fasteners are used to redundantly maintain the connection by complementing the frictional holding force between the connecting parts. Commonly, these fasteners are grippable to be turned by hand and/or have a configuration to accept a turning tool, such as a screwdriver or wrench. To secure the devices, a cable, potentially of a relatively large gauge, is connected at the port and extends to, and is secured at, a fixed support location.

This type of security system has the advantage that it can be made relatively inexpensively. A relatively large cable can be conveniently connected to the particular electronic device by pressing in a "D"-type connector in the same manner that a functioning connector would be installed. By then simply tightening the screws, a secure connection of the cable to the electronic device is established. An attempt to pull the cable connector out of the electronic device would destroy the connector and/or the circuit board with which it is associated, thereby destroying the electronic device or damaging it to the point that substantial repairs may be required.

This latter type of system does have the drawback that the fastening screws used at the port are accessible to a would-be thief. Thus, the connection is prone to being defeated. Consequently, this type of security system acts in many cases to delay, but not prevent the success of, the efforts of a would-be thief.

The industry continues to seek out additional security systems that are "user friendly", affordable, and effective in terms of preventing theft.

SUMMARY OF THE INVENTION

In one form, the invention is directed to the combination of an electronic device and a security system for monitoring the electronic device with the security system in an operative state with respect to the electronic device. The electronic device has a port with a connector assembly through which an electrical path to the electronic device can be established and at least a first threaded opening. The security system has a housing and at least a first fastener that can be directed into the at least first threaded opening and changed from a pre-assembly position into a secured position to thereby maintain the housing in an operative position on the electronic device. At least one component is directed into the housing to block access to the at least first fastener as might allow changing of the at least first fastener from the secured position into the pre-assembly position. The housing is securable relative to a support to confine movement of the electronic device relative to the support.

In one form, the at least one component is an elongate element that is directed fully through the housing.

The elongate element may be a flexible cable that has an associated shoulder that blocks separation of the flexible cable from the housing.

In one form, the flexible cable is connected to the support and has a length between the housing and support that allows the electronic device to be repositioned relative to the support within a distance approximately equal to the length.

In one form, the at least one component is a threaded element that is directed into the housing.

The connector assembly may be in the form of a projecting, D-shaped shield assembly. The housing has a receptacle to a receive at least a part of the D-shaped shield assembly.

In one form, the connector assembly has a second threaded opening and the security system further has a second fastener that can be directed into the second threaded opening and changed from a pre-assembly position into a secured position. The at least one component blocks access to the second fastener as might allow the second fastener to be changed from its secured position into its pre-assembly position.

The first and second fasteners may be directed respectively along first and second axes through first and second stepped bores extending in spaced, parallel relationship through the housing.

In one form, the at least one component is in the form of a first threaded element that is directed into the housing in a direction transverse to the first axis and into the first bore so as to block access to the first fastener in its secured position through the first bore.

The at least one component may include a second threaded element that is directed into the housing in a direction transverse to the second axis and into the second bore so as to block access to the second fastener in its secured position through the second bore.

The security system may further include an elongate cable having an end that is secured to the housing. The elongate cable is connected to the support to confine movement of the housing and thereby the electronic device relative to the support.

In one form, the elongate cable has a shoulder at or adjacent to the end of the cable that abuts the housing to prevent separation of the cable end from the housing. The shoulder may be defined by a fitting that is captive between the housing and the electronic device with the security system in the operative state.

In one form, there is a through bore with an axis generally parallel to the first and second axes into which the cable extends.

The fitting may reside at least partially in the receptacle with the security system in the operative state.

In one form, the first threaded element bears against the cable to fix the cable relative to the housing.

In one form, the first threaded element has a head that is configured to be engaged and turned by a special, complementary turning tool and not by a conventional turning tool.

In one form, the at least one component is a cable that is directed into a cross bore that has an axis that extends transversely to the first and second axes. The cable in the cross bore blocks access to the first and second fasteners through the first and second bores.

In one form, the housing is required to be assembled to the electronic device before the cable is directed through the cross bore.

In one form, the fitting is secured to the cable with the cable directed through the cross bore and has a shoulder that abuts the housing to prevent separation of the cable from the housing.

The electronic device may have a circuit board to which the connector assembly is electrically and mechanically connected.

The invention is further directed to a method of confining movement of an electronic device relative to a support. The method includes the steps of: providing an electronic device having a port with a connector assembly through which an electrical path to the electronic device can be established, and a first opening; securing a housing to the electronic device using a first fastener that is directed into a first bore through the housing into the first opening and thereafter changing the first fastener from a pre-assembly position into a secured position; with the fastener in the secured position, directing a first component into the housing so as to block access to the first fastener through the first bore as would allow the first fastener to be changed from the secured position into the pre-assembly position; and securing the housing relative to a support to thereby confine movement of the electronic device relative to the support.

In one form, the step of directing a first component into the housing involves extending a cable through the housing, and the step of securing the housing relative to the support involves securing the housing relative to the support through the cable.

The step of directing a first component into the housing may involve directing a threaded element into the housing.

The step of securing the housing may involve connecting a cable to the housing in between the housing and the support, with the step of directing a first component into the housing involving directing a threaded element into the housing and against the cable to thereby fix the cable relative to the housing.

BRIEF DESCRIPTION OF THE DRAWINGS

FIG. 9 is a view of another form of the inventive security system, as in FIG. 4, with a modified form of housing, according to the present invention;

FIG. 10 is a front elevation view of the housing in FIG. 9;

FIG. 11 is a side elevation view of the housing in FIGS. 9 and 10;

DETAILED DESCRIPTION OF THE DRAWINGS

Figure 1:
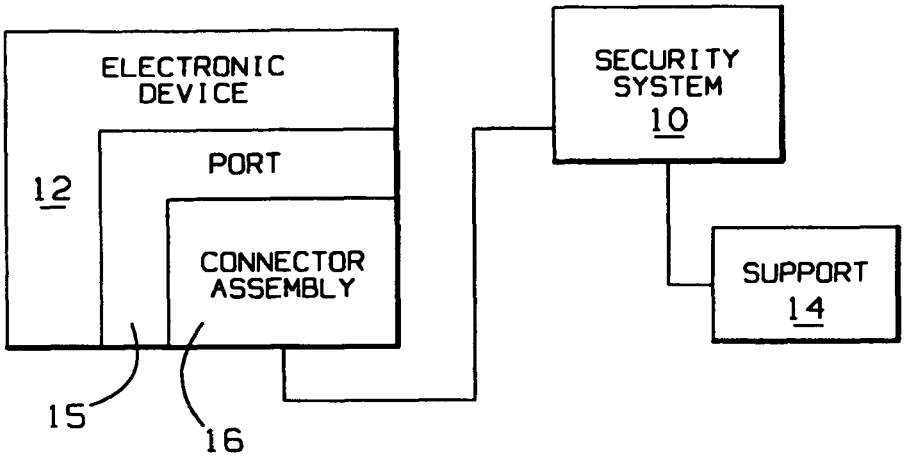
FIG. 1 is a schematic representation of the inventive security system that is secured through a connector assembly to a port on an electronic device to confine movement of the electronic device relative to a support.

In FIG. 1, a security system, according to the present invention, is shown at 10, for confining movement of an electronic device 12 relative to a support 14. The electronic device 12 may take virtually a limitless number of different forms. Preferably, the electronic device 12 is a type having a port 15 with a connector assembly 16 through which an electrical path to the electronic device 12 can be established.

Figure 2:
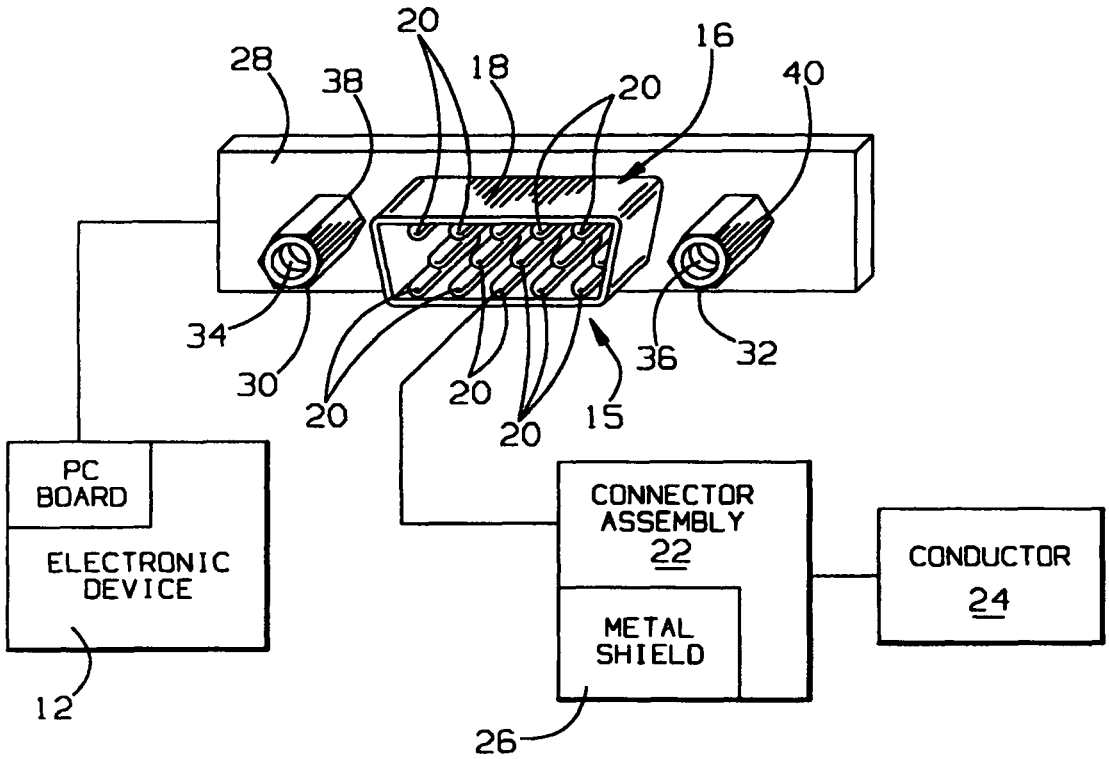
FIG. 2 (PRIOR ART)
FIG. 2 is a partially schematic representation of the electronic device depicted in FIG. 1 but with a conductor attached to the port and connector assembly for normal operation.

The security system 10 will now be described in relationship to the exemplary electronic device 12, wherein the connector assembly 16 at the port 15 thereon is in the form of a "D"-type connector, as shown in FIG. 2. Specifically, the connector assembly 16 has a D-shaped metal shield 18 that surrounds a series of male connectors/plugs 20. While male connectors/plugs 20 are shown, the structure might alternatively utilize female connectors/sockets in place of the plugs 20. Regardless of whether the connectors are male or female, it is contemplated that through the connector assembly 16, and a complementary connector assembly 22, an electrical path can be established for a conductor 24, associated with the connector assembly 22, to the electronic device 12, as to a PC board thereon.

The connector assembly 22 will typically have a metal shield 26 that is complementary in shape to the metal shield 18 so that the metal shields 18, 26 can be directed, one within the other, by relatively moving the connector assembly 22 in a translational path relative to the connector assembly 16. The metal shields 18, 26, in conjunction with screens (not shown) on the conductor 24, creates a continuous electrical screen around the connecting location and the conductor 24.

As earlier noted, the nature of the electronic device 12 is not critical to the present invention. The connector assembly 16, in the form shown in FIG. 2, is likewise only exemplary in nature and is particularly adaptable to the inventive concepts. It is contemplated that the inventive concept can be used with other type of connector assemblies, and associated with different types of electronic devices, that may be computer related or in a completely different technological area.

The "D"-type connector assembly 16 shown in FIG. 2 typically has a plate 28 carrying the metal shield 18. The plate 28 additionally supports first and second fittings 30, 32, respectively having first and second threaded openings 34, 36.

Typically, the connector assembly 22 will be press fit to the connector assembly 16 and will be frictionally held to establish the desired electrical path from the conductor 24 to the PC Board on the electronic device 12. To avoid inadvertent separation of the connector assemblies 16, 22, fasteners (not shown in FIG. 2) are directed through the connector assembly 22 and, one each, into the threaded openings 34, 36. The fittings 30, 32 have polygonally-shaped peripheries 38, 40, respectively, which allow them to be engaged and turned/held by a conventional wrench.

Figure 3:
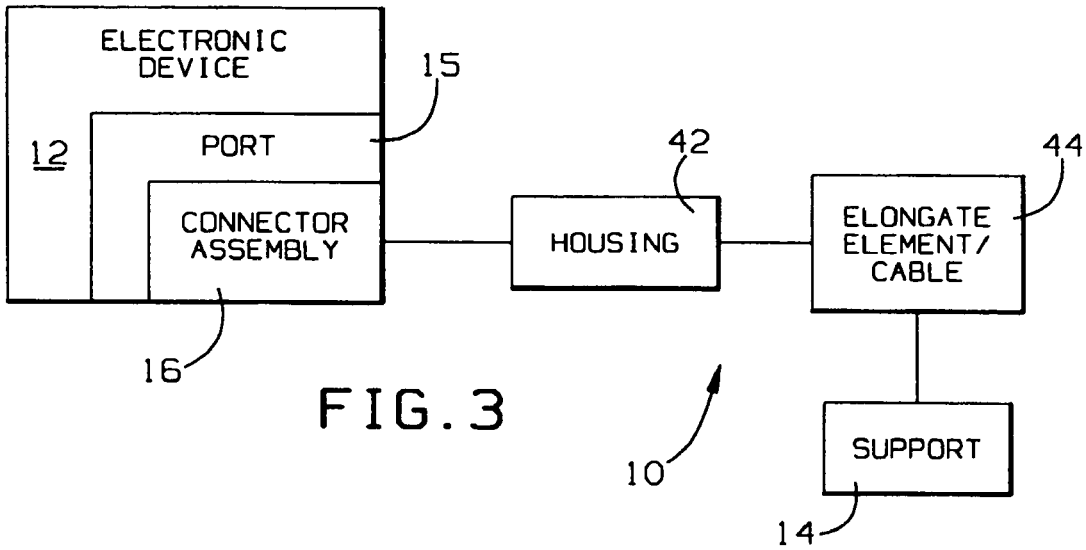
FIG. 3 is a schematic representation of the inventive security system connected to the electronic device in FIG. 1 and showing components thereof including a housing and an elongate element/cable.
Figure 4:
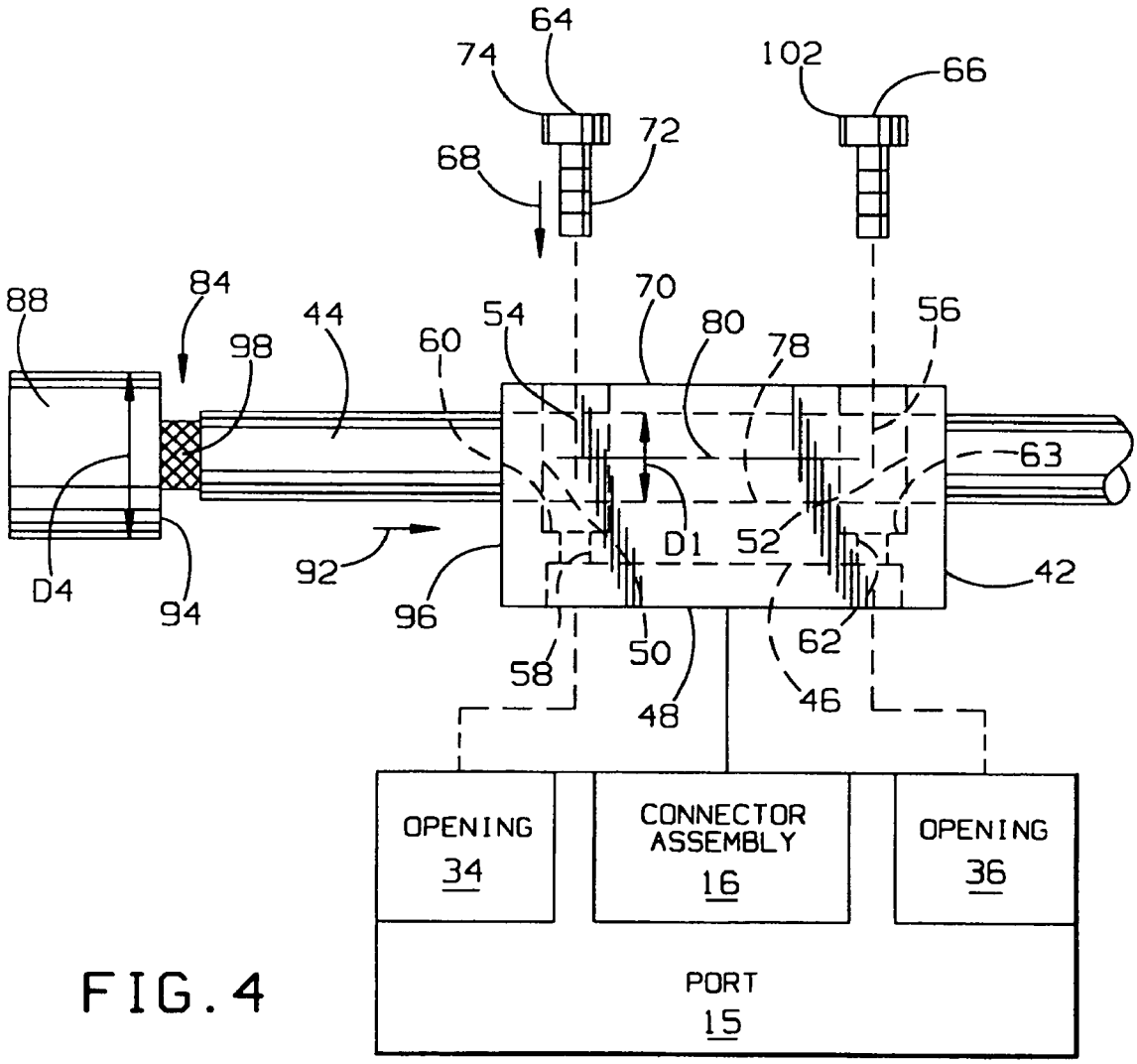
FIG. 4 is a partially schematic, elevation view of the inventive security system on an electronic device with one form of the housing, as shown in FIG. 3, and associated elongate element/cable.
Figure 5:
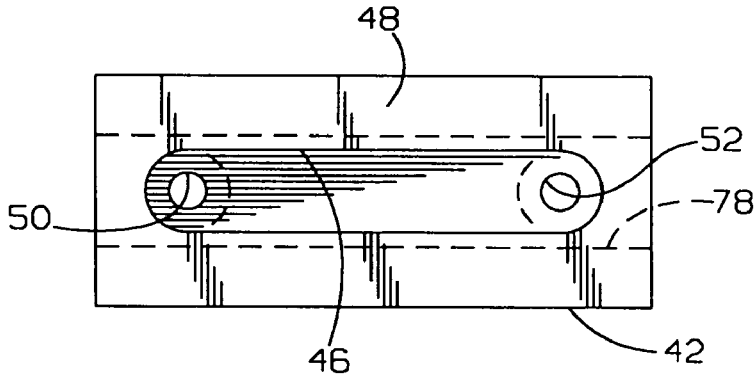
FIG. 5 is front elevation view of the housing in FIG. 4.
Figure 6:
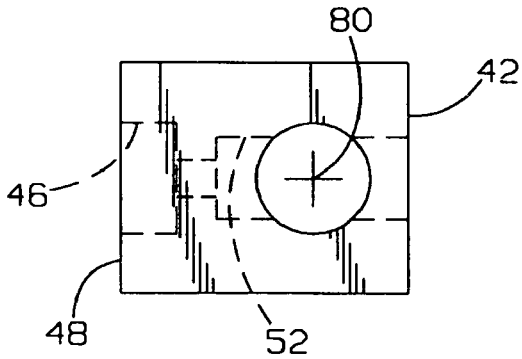
FIG. 6 is a side elevation view of the housing in FIGS. 4 and 5.
Figure 8:
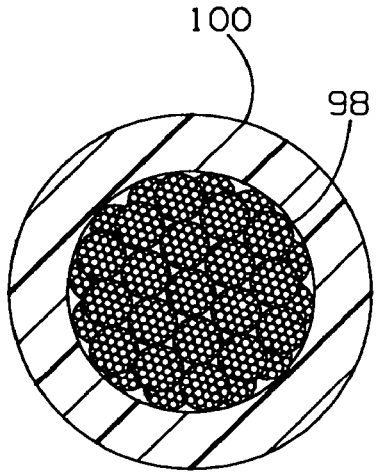
FIG. 8 is an enlarged, cross-sectional view of the elongate element/cable taken along lines 8-8 of FIG. 7.

According to the invention, the security system 10 is operatively connected to the electronic device 12 through the connector assembly 16 in place of the connector assembly 22. More specifically, as shown generically in FIG. 3, the inventive security system 10 consists of a housing 42 that is operatively connected at the port 15 at the connector assembly 16 and has an associated elongate element/cable 44 that extends between the housing 42 and support 14, so as to confine movement of the electronic device 12 relative to the support 14 within a range approximately equal to the length of the elongate element/cable 44.

One specific form of the security system 10 is shown on FIGS. 4-8. The housing 42 is shown to have a squared overall peripheral outer shape. The precise shape of the housing 42 is not critical to the present invention. The housing 42 may be made from metal, plastic, a composite, or other material with the requisite durability and strength.

The housing 42 has a formed receptacle 46 of a dimension to receive part or all of the metal shield 18. The housing 42 is placed into the operative position by directing the metal shield 18 into the receptacle 46 so that a wall 48 on the housing 42 is at, or in close proximity to, the fittings 30, 32. The fittings 30, 32, with the housing configuration shown, are received at least partially within the receptacle 46.

Stepped, first and second through bores 50, 52 are formed through the housing 42, respectively along spaced, parallel axes 54, 56, which align to respectively coincide with the central axes for the openings 34, 36 on the port 15. The bore 50 has a reduced diameter portion 58 communicating to the receptacle 46 with an annular, axially facing shoulder 60 defined within the bore 50 where the reduced diameter portion 58 begins. The bore 52 has a like reduced diameter portion 62 with an annual shoulder 63 defined within the bore 52 where the reduced diameter portion 62 begins.

The housing 42 is maintained in the operative position upon the electronic device 12 by first and second fasteners 64, 66. The fastener 64 is directed through the bore 50 from a pre-assembly position shown in the direction of the arrow 68 and initially through a wall 70 on the housing 42 facing oppositely to the wall 48. A threaded shank 72 on the fastener 64 engages within the opening 34 on the port 15 and is turned to a tightened state. Turning is accomplished through a head 74 that may accept a conventional tool or be configured to be turned only by a complementary security tool. By tightening the fastener 64 to a secured position, the head 74 thereon is caused to bear against the annular shoulder 60, thereby drawing the housing 42 towards the port 15. The fastener 66 is installed in a like manner.

While threaded fasteners 64, 66 are disclosed, any type of fastener that can be directed through the bores 50, 52 and manipulated within the bores 50, 52 to thereby change the fasteners from a pre-assembly position into a secured position, is contemplated. The exemplary threaded connection for the fasteners 64, 66 is disclosed in that such fasteners can be easily turned within the existing threaded openings 34, 36 at the port 15 to thereby change the fasteners 64, 66 from the pre-assembly position into the secured position therefor, wherein the housing 42 is maintained in an operative position upon the electronic device 12.

Once the fasteners 64, 66 are placed in their secured positions, a component, in this case, the elongate element/cable 44, is directed through a cross bore 78 extending fully through the housing 42 and having a central axis 80 that is transverse to, and in the depicted form coincident with, the axes 54, 56 for the bores 50, 52 respectively.

Figure 7:
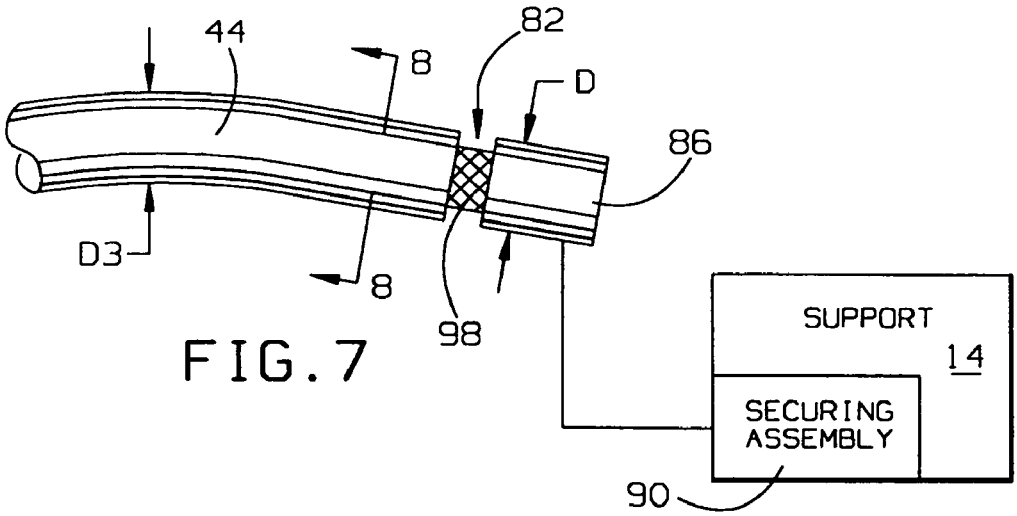
FIG. 7 is a fragmentary view of the end of the elongate element/cable connected to the support in FIG. 1, shown in schematic form.
Figure 12:
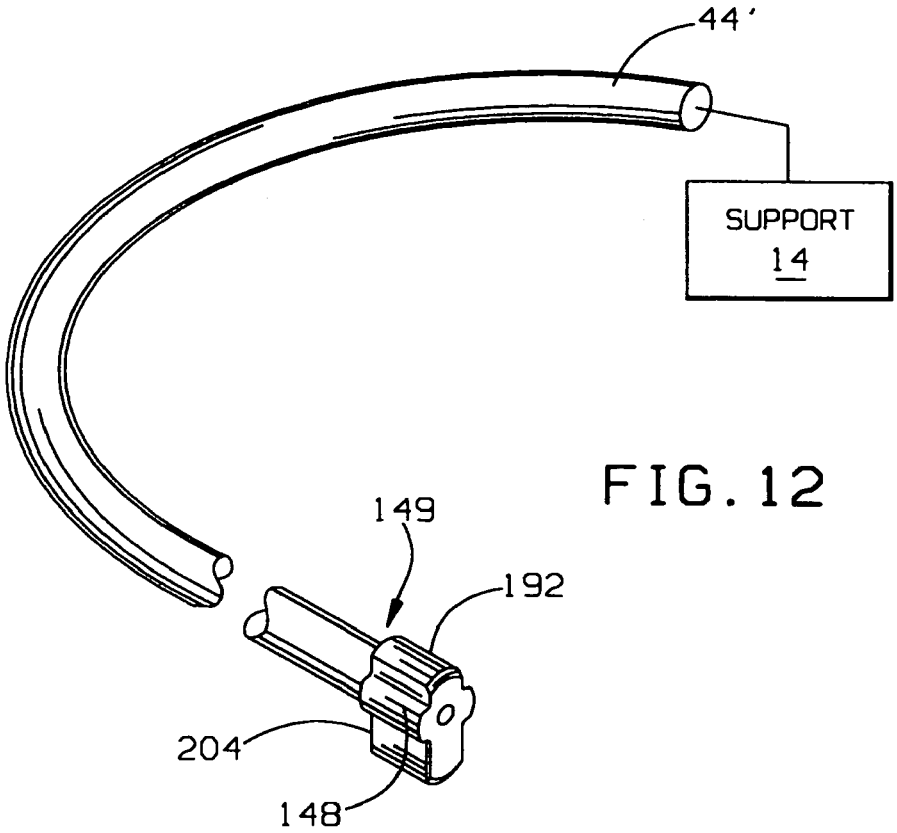
FIG. 12 is a perspective view of the cable used on the inventive security system in FIGS. 9-11.
Figure 14:
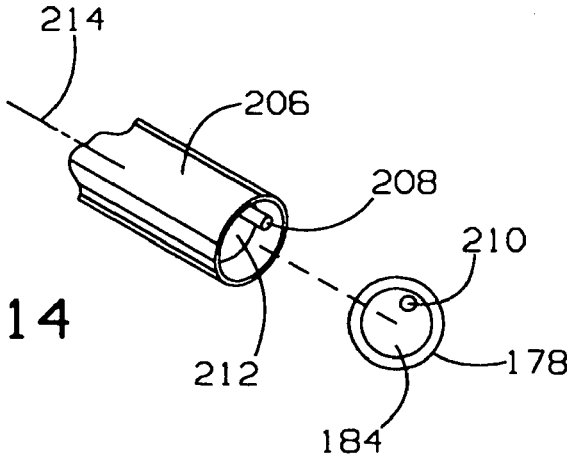
FIG. 14 is a fragmentary, perspective view of a tool for engaging and turning a head on a securing element, shown in relationship thereto in this Figure, and also in FIG. 9.

In this embodiment, the elongate element/cable 44, as seen additionally in FIG. 7, has spaced ends 82, 84 at which fittings 86, 88 are respectively secured. The fitting 86 is designed to be maintained by a securing assembly 90 upon/at the support 14. The fitting 86 preferably has a diameter D that is slightly less than the diameter D1 of the cross bore 78. The body of the elongate element/cable 44 has an outer diameter D3 that is approximately equal to the diameter D and less than the diameter D1, whereby the fitting 86 and following body can be moved through the cross bore 78 in the housing 42 in the direction of the arrow 92 in FIG. 4 to a point that an annular shoulder 94 on the fitting 88 abuts to a wall 96 on the housing 42 to prevent passage of the end 84 through the housing 42 and thereby separation of the elongate element/cable 44 from the housing 42.

The relationship of the axis 80 of the cross bore 78 to the axes 54, 56 is such that the axis 80 is preferably adjacent to or intersects one or both axes 54, 56. Accordingly, with the elongate element/cable 44 directed through the cross bore 78, the elongate element/cable 44 blocks access to the fasteners 64, 66, in their secured positions, through the bores 50, 52, respectively. Thus, with the end 82 secured to the support 14, the elongate element/cable 44 is prohibited from being withdrawn from the cross bore 78 by sliding movement in either direction therethrough as would allow access to the fasteners 64, 66 as might allow them to be loosened and placed back in their pre-assembly positions, whereupon the housing 42 could be separated from the electronic device 12.

The nature of the elongate element/cable 44 is not critical to the present invention. The elongate element/cable 44 might be in the form of a straight, rigid rod. More preferably, the elongate element/cable 44 is made with a flexible configuration that is resistant to being severed. As shown particularly in FIG. 8, the elongate element/cable 44 may have a braided wire core 98 surrounded by a softer, encasing layer 100.

The fittings 86, 88 may be crimp-type fittings or may be otherwise fixedly secured to the core 98 and/or layer 100. Any structure known to those skilled in the art that creates an enlargement is contemplated.

As noted above, the elongate element/cable 44 may be pre-formed in the configuration shown and may be assembled to the housing 42 by directing the end 82 with the smaller diameter fitting 86 through the cross bore 78. Alternatively, the end 82 may be preliminarily assembled or permanently attached to the support 14. The end 84 without the fitting 88 thereon may then be directed through the cross bore 78 oppositely to the direction indicated by the arrow 92. Once the end 84 projects from the housing 42, the fitting 88 can be installed and secured in place, as by crimping.

The fitting 88 is chosen to have a diameter D4 that will not pass through the cross bore 78, as a result of which the shoulder 94 defined thereon bears upon the housing 42 in the event that the elongate element/cable 44 is drawn through the cross bore 78 in the direction of the arrow 92.

The relative positions of the bores 50, 52, 78, and their diameters are selected so that with the fasteners 64, 66 in their secured positions, the inserted elongate element/cable 44 is spaced slightly from the annular shoulders 60, 63 to accommodate respectively the head 74 of the fastener 64 and a like head 102 on the fastener 66.

An alternative housing configuration is shown on a modified system, shown in FIGS. 8-13. The housing 142 has the same general shape and dimensions as the housing 42. The housing 142 has a receptacle 146 to accept part or all of the connector assembly 16. The receptacle 146 is dimensioned to except an enlarged fitting 148 on an elongate element/cable 44', having a similar configuration to the aforementioned elongate element/cable 44. The fitting 148 may be crimped to one end 149 thereof, with the opposite end of the elongate element/cable 44' suitably connected to the support 14.

First and second stepped, through bores 150, 152 extend fully through the housing 142, respectively along spaced, substantially parallel axes 154, 156. The first bore 150 has a reduced diameter portion 158 which meets a larger diameter portion 160 at an annular shoulder 162. The fastener 64 is directed into and through the bore 150 in the direction of the arrow 164 into the port opening 34 and is turned to change the fastener 64 from a pre-assembly position into a secured position therefor. In the latter position, the fastener head 74 bears upon the shoulder 162 to draw the 142 housing towards the port 15 and maintain the housing 142 in the operative position therefor. The fastener 66 is installed in like manner to be secured within the opening 36.

Stepped bores 166, 168 are formed through the housing walls 170, 172, respectively. The bores 166, 168 have axes 174, 176, respectively, which each is adjacent to or coincides with one or both of the axis 154, 156 for the bores 150, 152. In the embodiment shown, the axes 174, 176 are coincident to allow the smaller diameter portions of the bores 166, 168 to be formed in a single drilling step.

First and second securing elements 178, 180 are directed respectively into the bores 166, 168. The exemplary securing element 178 passes into/through the through bore 150 so as to thereby block access to the fastener 64, in the secured position, through the bore 150 through the housing wall 182. With the stepped arrangement of the bore 166, with the securing element 178 tightened, a head 184 thereon sits at least partially in a recess 186 so as to not project significantly outwardly from the wall 170. The head 184 is tapered so that any projecting portion does not have sharp edges that might be inadvertently contacted as the electronic device 12, with the housing 142 thereon, is being handled. The securing element 180 is assembled in a like manner, with the head 188 thereon residing in a recessed 190.

The securing elements 178, 180 can be made with a sufficient length to project into the receptacle 146 to thereby engage the elongate element/cable 44', and more particularly the fitting 148 thereon. However, it is only necessary that they extend sufficiently into the bores 150, 152 to block access to the fasteners 64, 66 in their secured portions.

Figure 13:
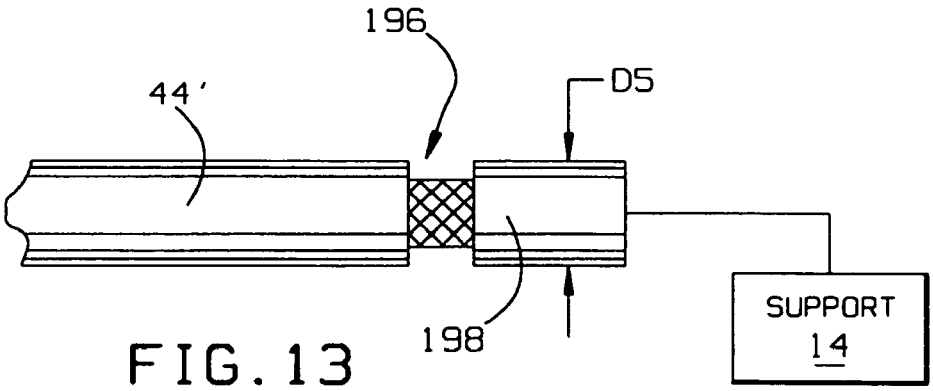
FIG. 13 is a fragmentary, partially schematic, view of one of the ends of the elongate element/cable connected to the aforementioned support.

The fitting 148 is shown with a non-circular, peripheral wall 192 so as to be keyed with a nominally matched surface 194 bounding the receptacle 146. The elongate element/cable 44' may be pre-formed with the fitting 148 thereon. In that event, as shown in FIG. 13, the end 196 of the elongate element/cable 44' may have a fitting 198 with a diameter D5 that is less than the diameter of an opening 200 that extends through the housing wall 182 into communication with the receptacle 146. With this arrangement, the fitting 198 on the end 196 can be moved in the direction of the arrow 202 in FIG. 9 into and through the opening 200 and extended therefrom to be connected suitably to the support 14. The fitting 148 has a shoulder 204 with an effective diameter that is greater than that of the opening 200 so that the fitting 148 cannot be withdrawn from the receptacle 146 through the opening 200.

With the fitting 148 in the receptacle 146 and the securing elements 178, 180 either separated from the housing 142 or backed out of the bores 150, 152 to other pre-assembly positions, the housing 142 can be placed over the connector assembly 16. Thereafter, the fasteners 64, 66 can be directed into the bores 150, 152 and into the port openings 34, 36 and tightened, each to be changed from its pre-assembly position into the secured position therefor, as for the embodiment previously described. Thereafter, the securing elements 178, 180 are directed into the bores 150, 152 to block access to the fastener 64, 66 through the openings 150, 152 that might otherwise allow the fastener 64, 66 to be changed from the secured positions into the pre-assembly positions therefor.

The head 184 on the exemplary securing element 178 may have a special configuration to be engaged by only a complementary special, custom-designed tool 206, shown in FIG. 13, that is non-conventional in nature. That is, the tool 206 is not an off-the-shelf item such as a screwdriver or wrench. The depicted tool 206 has a post 208 that fits within a recess 210 on the head 184. The tool 206 has a blind opening 212 which accepts the head 184 with the post 208 projected into the recessed 210. The tool 206 is turnable about central axis 214 in opposite directions to selectively tighten and release the securing element 178. Accordingly, the securing elements 178, 180 block access to the fasteners 64, 66. The securing elements 170 and 180 cannot be easily removed without the use of the special tool 206.

As for the earlier described embodiment, the elongate element/cable 44' may be pre-formed and assembled to the housing 142 by directing the fitting 198 through the housing 142 and moving the elongate element/cable 44' to the point that the fitting 148 resides within the receptacle 146. Alternatively, the cable end 149 may be directed through the housing 142 after which the fitting 148 is crimped in place.

Figure 15:
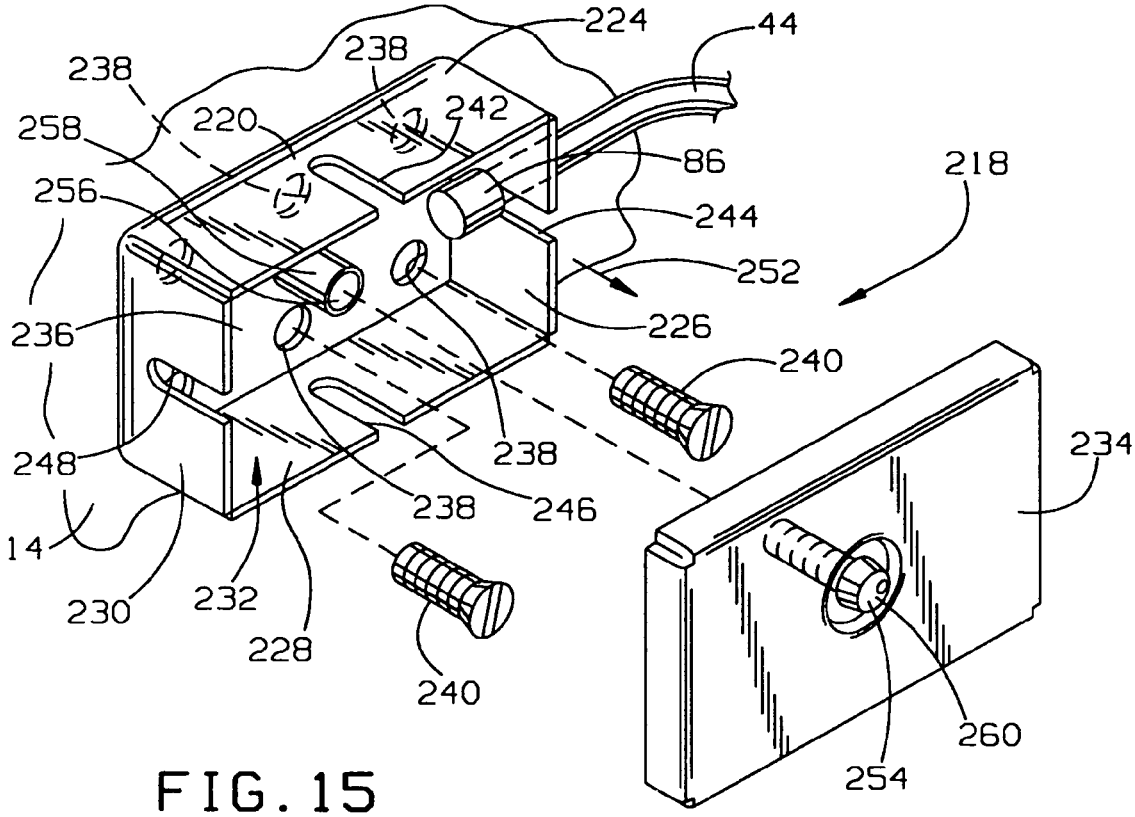
FIG. 15 is a fragmentary, exploded, perspective view of a locking box for securing an end of the elongate element/cable to a support.
Figure 16:
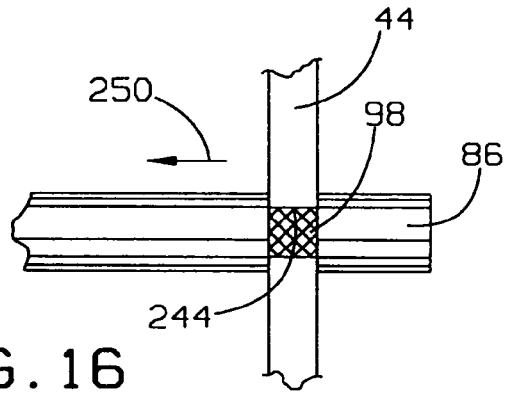
FIG. 16 is an enlarged, fragmentary, view of the connection between the end of the elongate element/cable and locking box.

As previously mentioned, the nature of the connection of the elongate element/cable 44, 44' to the support 14 is not critical to the present invention. In one exemplary form, as shown in FIGS. 15 and 16, a locking box arrangement is shown at 218. The locking box consists of a main box part 220, with in this case consists of four walls 224, 226, 228, 230 bounding a generally squared receptacle 232 that can be selectively closed by a cover 234. The main box part 220 has a base wall 236 and a series of openings 238 therethrough to accept fasteners 240 that can be directed into the support 14, be it a wall, or other fixed structure.

The walls 224, 226, 228, 230 each has a U-shaped slot 242, 244, 246, 248 formed therein. As shown on FIG. 16, for exemplary slot 244, the core 98 of the exemplary elongate element/cable 44 fits closely within the slot 244 such that the fitting 86 is precluded from being drawn in the direction of the arrow 250 from the slot 244. With the cover 234 placed upon the main box part 220, the slot 244 is blocked thereby to prevent the cable core 98 from being moved out of the slot 244 in the direction of the arrow 252 in FIG. 15. The elongate element/cable 44 cooperates with the other slots 242, 246, 248 in a like manner.

A securing element 254 extends through the cover 234 and into a complementarily threaded bore 256 on a post 258 projecting from the base wall 236. The securing element 254 has a head 260 that is designed to cooperate with the tool 206, or another security-type tool.

Figure 17:
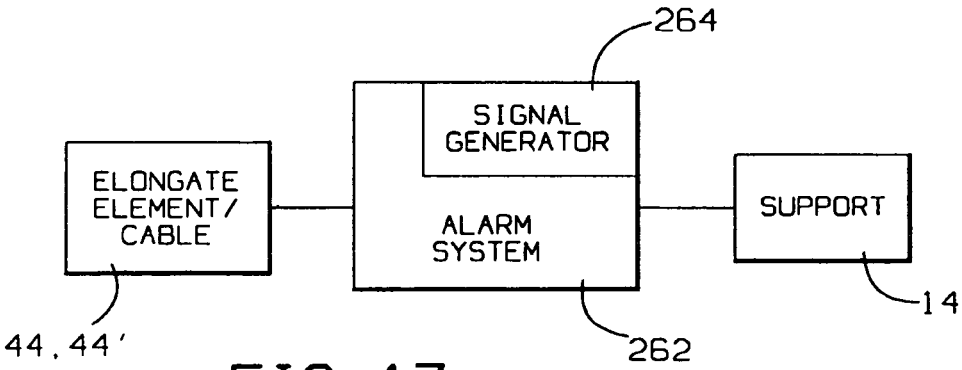
FIG. 17 is a schematic representation of another connection between the elongate element/cable and support and incorporating an alarm system to alert a user in the event of a breach.

As shown on FIG. 17, as an alternative to a strictly mechanical connection, the elongate element/cable 44, 44' may be connected to the support 14 through an alarm system 262 that may generate a detectible signal through a generator 264, in the event that the elongate element/cable 44, 44' is severed and/or separated from the port 15.

Many variations of the systems described hereinabove are contemplated. As just one example, a single fastener may be used to maintain the housing 42, 142 upon the support 15.

Other variations are contemplated and would be obvious to those skilled in the art based upon the disclosure herein.

The foregoing disclosure of specific embodiments is intended to be illustrative of the broad concepts comprehended by the invention.

The invention claimed is:

1. In combination:

a) an electronic device having a port with a connector assembly through which an electrical path to the electronic device can be established and at least a first threaded opening; and b) a security system for monitoring the electronic device with the security system in an operative state with respect to the electronic device, the security system comprising:

a housing;

at least a first fastener that can be directed into the at least first threaded opening and changed from a pre-assembly position into a secured position by turning the at least first fastener to thereby maintain the housing in an operative position on the electronic device; and at least one component that is directed into the housing to block access to the at least first fastener to allow a turning force to be applied tending to change the at least first fastener from the secured position into the pre-assembly position, the housing securable relative to a support to confine movement of the electronic device relative to the support, wherein the housing is directly engaged with the connector assembly.

2. The combination according to claim 1 wherein the at least one component comprises an elongate element that is directed fully through the housing.

3. The combination according to claim 2 wherein the elongate element comprises a flexible cable that has an associated shoulder that blocks separation of the flexible cable from the housing.

4. The combination according to claim 3 wherein the flexible cable is connected to the a support and has a length between the housing and support that allows the electronic device to be repositioned relative to the support within a distance approximately equal to the length.

5. The combination according to claim 1 wherein the at least one component comprises a threaded element that is directed into the housing.

6. The combination according to claim 1 wherein the connector assembly comprises a projecting D-shaped shield assembly and the housing has a receptacle to receive at least a part of the D-shaped shield assembly.

7. The combination according to claim 6 wherein the connector assembly has a second threaded opening and the security system comprises a second fastener that can be directed into the second threaded opening and changed from a pre-assembly position into a secured position and the at least one component blocks access to the second fastener as might allow the second fastener to be changed from its secured position into its pre-assembly position.

8. The combination according to claim 7 wherein the first and second fasteners are directed respectively along first and second axes through first and second stepped bores extending in spaced, parallel relationship through the housing.

9. In combination:

a) an electronic device having a port with a connector assembly through which an electrical path to the electronic device can be established and at least a first threaded opening; and b) a security system for monitoring the electronic device with the security system in an operative state with respect to the electronic device, the security system comprising:

a housing;

at least a first fastener that can be directed into the at least first threaded opening and changed from a pre-assembly position into a secured position to thereby maintain the housing in an operative position on the electronic device; and at least one component that is directed into the housing to block access to the at least first fastener as might allow changing of the at least first fastener from the secured position into the pre-assembly position, the housing securable relative to a support to confine movement of the electronic device relative to the support, wherein the connector assembly comprises a projecting D-shaped shield assembly and the housing has a receptacle to receive at least a part of the D-shaped shield assembly, wherein the connector assembly has a second threaded opening and the security system comprises a second fastener that can be directed into the second threaded opening and changed from a pre-assembly position into a secured position and the at least one component blocks access to the second fastener as might allow the second fastener to be changed from its secured position into its pre-assembly position, wherein the first and second fasteners are directed respectively along first and second axes through first and second stepped bores extending in spaced, parallel relationship through the housing, wherein the at least one component comprises a first threaded element that is directed into the housing in a direction transverse to the first axis and into the first bore so as to block access to the first fastener in the secured position through the first bore.

10. The combination according to claim 9 wherein the at least one component comprises a second threaded element that is directed into the housing in a direction transverse to the second axis and into the second bore so as to block access to the second fastener in its secured position through the second bore.

11. The combination according to claim 9 wherein the security system further comprises an elongate cable having an end that is secured to the housing, the elongate cable connects to the support to confine movement of the housing and thereby the electronic device relative to the support.

12. The combination according to claim 11 wherein the elongate cable has a shoulder at or adjacent to the end of the cable that abuts the housing to prevent separation of the cable end from the housing.

13. The combination according to claim 12 wherein the shoulder is defined by a fitting that is captive between the housing and the electronic device with the security system in the operative state.

14. The combination according to claim 12 wherein there is a through bore with an axis generally parallel to the first and second axes into which the cable extends.

15. The combination according to claim 13 wherein the fitting resides at least partially in the receptacle with the security system in the operative state.

16. The combination according to claim 14 wherein the first threaded element bears against the cable to fix the cable relative to the housing.

17. The combination according to claim 16 wherein the first threaded element has a head that is configured to be engaged and turned by a complementary turning tool and not by a conventional turning tool.

18. In combination:

a) an electronic device having a port with a connector assembly through which an electrical path to the electronic device can be established and at least a first threaded opening; and b) a security system for monitoring the electronic device with the security system in an operative state with respect to the electronic device, the security system comprising:

a housing;

at least a first fastener that can be directed into the at least first threaded opening and changed from a pre-assembly position into a secured position to thereby maintain the housing in an operative position on the electronic device; and at least one component that is directed into the housing to block access to the at least first fastener as might allow changing of the at least first fastener from the secured position into the pre-assembly position, the housing securable relative to a support to confine movement of the electronic device relative to the support, wherein the connector assembly comprises a projecting D-shaped shield assembly and the housing has a receptacle to receive at least a part of the D-shaped shield assembly, wherein the connector assembly has a second threaded opening and the security system comprises a second fastener that can be directed into the second threaded opening and changed from a pre-assembly position into a secured position and the at least one component blocks access to the second fastener as might allow the second fastener to be changed from its secured position into its pre-assembly position, wherein the first and second fasteners are directed respectively along first and second axes through first and second stepped bores extending in spaced, parallel relationship through the housing, wherein the at least one component comprises a cable that is directed into a cross bore that has an axis that extends transversely to the first and second axes, the cable in the cross bore blocking access to the first and second fasteners through the first and second bores.

19. The combination according to claim 18 wherein the housing is required to be assembled to the electronic device before the cable is directed through the cross bore.

20. The combination according to claim 19 wherein the fitting is secured to the cable with the cable directed through the cross bore and has a shoulder that abuts the housing to prevent separation of the cable from the housing.

21. The combination according to claim 1 wherein the electronic device comprises a circuit board to which the connector assembly is electrically and mechanically connected.

22. A method of confining movement of an electronic device relative to a support, the method comprising the steps of:

providing an electronic device comprising a port with a first connector assembly through which an electrical path to the electronic device can be established, and a first opening that is used to secure a second connector assembly with a conductor to establish an electrical path for the conductor to the electronic device;

securing a housing to the electronic device using a first fastener that is directed into a first bore through the housing and into the first opening and thereafter changing the first fastener from a pre-assembly position into a secured position;

with the first fastener in the secured position, directing a first component into the housing so as to block access to the first fastener through the first bore as would allow the first fastener to be manipulated to be changed from the secured position into the pre-assembly position; and securing the housing relative to a support to thereby confine movement of the electronic device relative to the support.

23. The method of confining movement of an electronic device relative to a support according to claim 22 wherein the step of directing a first component into the housing comprises extending a cable through the housing, and the step of securing the housing relative to the support comprises securing the housing relative to the support through the cable.

24. The method of confining movement of an electronics device relative to a support according to claim 22 wherein the step of directing a first component into the housing comprises directing a threaded element into the housing.

25. The method of confining movement of an electronics device relative to a support according to claim 22 wherein the step of securing the housing comprises connecting a cable comprising a fitting to the housing and between the housing and the support and the step of directing a first component into the housing comprises directing a threaded element into the housing and against the cable to thereby fix the cable relative to the housing.

* * * * *